US006386198B1

(12) United States Patent
Rugless

(10) Patent No.: US 6,386,198 B1
(45) Date of Patent: May 14, 2002

(54) MULTI-PURPOSE OXYGEN FACE MASK

(76) Inventor: Florence Rugless, 8221 Garland Ave. #602, Takoma Park, MD (US) 20912

( * ) Notice: Subject to any disclaimer, the term of this patent is extended or adjusted under 35 U.S.C. 154(b) by 345 days.

(21) Appl. No.: 08/989,056

(22) Filed: Dec. 11, 1997

(51) Int. Cl.[7] ..... A62B 18/02

(52) U.S. Cl. ..... 128/206.21; 128/205.25; 128/206.24

(58) Field of Search ..... 128/205.25, 206.21, 128/206.24

(56) References Cited

U.S. PATENT DOCUMENTS

| | | | | | |
|---|---|---|---|---|---|
| 2,625,155 | A | * | 1/1953 | Engelder | 128/206.12 |
| 3,467,093 | A | | 9/1969 | Hotz et al. | |
| 3,752,157 | A | * | 8/1973 | Malmin | 128/207.11 |
| 4,201,205 | A | | 5/1980 | Bartholomew | |
| 4,328,797 | A | * | 5/1982 | Rollins, III et al. | 128/202.27 |
| 4,414,973 | A | * | 11/1983 | Matheson et al. | 128/206.15 |
| 4,458,679 | A | * | 7/1984 | Ward | 128/201.13 |
| 4,832,017 | A | * | 5/1989 | Schnoor | 128/206.12 |
| 4,951,664 | A | * | 8/1990 | Niemeyer | 128/206.24 |
| 5,005,571 | A | * | 4/1991 | Dietz | 128/205.25 |
| 5,025,805 | A | * | 6/1991 | Nutter | 128/207.18 |
| 5,143,061 | A | * | 9/1992 | Kaimer | 128/206.24 |
| 5,322,061 | A | | 6/1994 | Brunson | |
| D351,226 | S | | 10/1994 | Parvatharaj | |
| 5,361,771 | A | | 11/1994 | Craine et al. | |
| 5,400,781 | A | * | 3/1995 | Davenport | 128/206.28 |
| 5,429,125 | A | | 7/1995 | Wagner et al. | |
| 5,431,158 | A | | 7/1995 | Tirotta | |
| 5,474,060 | A | * | 12/1995 | Evans | 128/204.22 |
| 5,492,114 | A | | 2/1996 | Vroman | |
| 5,509,409 | A | * | 4/1996 | Weatherholt | 128/207.18 |
| 5,558,089 | A | * | 9/1996 | Castiglione | 128/206.16 |
| 5,586,551 | A | | 12/1996 | Hilliard | |

FOREIGN PATENT DOCUMENTS

| | | | | |
|---|---|---|---|---|
| CA | 618808 | * | 4/1961 | 128/207.11 |
| DE | 1104122 | * | 4/1961 | 128/207.11 |
| FR | 850549 | * | 12/1939 | 128/206.12 |

* cited by examiner

*Primary Examiner*—John G. Weiss
*Assistant Examiner*—Joseph Weiss
(74) *Attorney, Agent, or Firm*—John D. Gugliotta

(57) ABSTRACT

A multi-purpose oxygen face mask which functions as three different masks at once: regular, aerosol, and non-rebreather is disclosed. The mask fits over the nose and mouth area of the wearer and is secured by a head strap, a neck strap and a bendable aluminum strip over the nose area. The straps are secured by a multiple hole adjustment and securing system and those straps that come in contact with a patient's cheek and ear area are padded with a soft foam padding for increased comfort. A plurality of access ports with snap covers allows for the connection of standard hoses and attachments to configure to mask in the abovementioned manners. The ports are duplicated on either side of the mask to allow for access from the right or left side of the patient's body.

11 Claims, 4 Drawing Sheets

MULTI-PURPOSE OXYGEN FACE MASK

RELATED APPLICATIONS

The present invention was first described in Disclosure Document Number 415,787 filed on Mar. 10, 1997.

BACKGROUND OF THE INVENTION

1. Field of the Invention

The present invention relates generally to oxygen masks and, more particularly, to oxygen masks that can serve the purpose of a regular oxygen mask, an aerosol oxygen mask, and a non-rebreather oxygen mask.

2. Description of the Related Art

In the related art, numerous attempts have been made to improve the function of oxygen masks used for patient care. These improvements have ranged from utilization improvements to patient comfort improvements. A search of the prior art did not disclose any patents that read directly on the claims of the instant invention; however, the following references were considered related:

| U.S. Pat. No. | Inventor | Issue Date |
|---|---|---|
| D351,226 | Regina Parvatharaj | Oct. 4, 1994 |
| 3,467,093 | L. F. Hotz, et al. | Dec. 9, 1996 |
| 4,201,205 | Victor Bartholomew | May 6, 1980 |
| 5,322,061 | Kevin Brunson | Jun. 21, 1994 |
| 5,361,771 | Brian Craine, et al. | Nov. 8, 1994 |
| 5,429,125 | Kurt Wagner, et al. | Jul. 4, 1995 |
| 5,431,158 | Christopher Tirotta | Jul. 11, 1995 |
| 5,492,114 | Holly Vroman | Feb. 20, 1996 |

Of considerable relevance is U.S. Pat. No. 5,586,551, issued to Hilliard. While the oxygen mask with nebulizer appears to incorporate two of three functions of the present invention, it does not provide for the use as a regular oxygen mask. Nor does it provide for the increased comfort of the wearer via use of two straps encircling the wearer's head. In addition other elements are different enough as to make the combination distinguished over the inventors' own prior art.

Consequently, a need has therefore been felt for an improved but less complex mechanism that allows for a single medical appliance mask to incorporate the functions of three conventional masks while allowing for the increased comfort of the wearer.

SUMMARY OF THE INVENTION

It is therefore an object of the present invention to provide an improved multi-purpose oxygen face mask.

It is a feature of the present invention to provide an improved multi-purpose oxygen face mask that provides the functions of three conventional oxygen masks, namely, a regular mask, an aerosol mask, and a non-rebreather mask. Such versatility allows for the use of one mask in instances where up to three specific use masks were required. The use of standard connection ports allows for the use of existing hoses and attachments.

It is another feature of the present invention to provide an improved multi-purpose oxygen face mask that utilizes a moldable plastic body that is lightweight and sanitary and whose performance and durability has been proven in numerous applications It is yet another Feature of the present invention to allow for the use of multiple attachment straps. The straps are adjustable to fit a wide range of patients, yet not of the elastic nature as to cause discomfort.

It is another feature of the present invention to allow for the use of a bendable aluminum bar to aid in the securing of the nose and upper cheek area of the mask to the patient's face.

Briefly described according to the preferred embodiment of the present invention, a multi-purpose oxygen face mask is disclosed which functions as three different masks cit once: regular, aerosol, and non-rebreather. The mask fits over the nose and mouth area of the wearer and is secured by a head strap, a neck strap and a bendable aluminum strip over the nose area. The straps are secured by a multiple hole adjustment and securing system. Those straps that come in contact with a patient's cheek and ear area are padded with a soft foam padding for increased comfort. A plurality of access ports with snap covers allows for the connection of standard hoses and attachments in order to configure the mask in the abovementioned manners. The ports are duplicated on either side of the mask to allow for access from the right or left side of the patient's body.

An advantage of the present invention is that the patient may wear it for long periods of time without the tight discomfort, chafing, rubbing or irritation that may result from long term use with a conventional oxygen mask.

Another advantage of the present invention is that user comfort is increased thus making the wearer more inclined to utilize the invention, resulting in a higher level of medical care.

Yet another advantage of the present invention is that it can be manufactured from readily available materials, utilizing common manufacturing technologies and techniques.

Another advantage of the present invention is that the function of the mask may be changed or reconfigured while the mask is still in place on the patient. This capability allows for the simultaneous use of two or more functions, thus allowing for an increased oxygen flow at all times. The patient is not subjected to instances of no oxygen flow where one mask must be removed while a mask of a different function is put on.

Yet another advantage of the present invention is that the mask may be installed around a patient's head and not over it. In cases where other medical appliances such as sensors, probes, monitors, etc. are attached to a patient's head or neck area, it is extremely difficult to install an oxygen mask with a continuous, closed elastic loop over the patient's head. The current invention allows for the connection straps to be threaded around said appliances and connected at the side surface of the mask.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
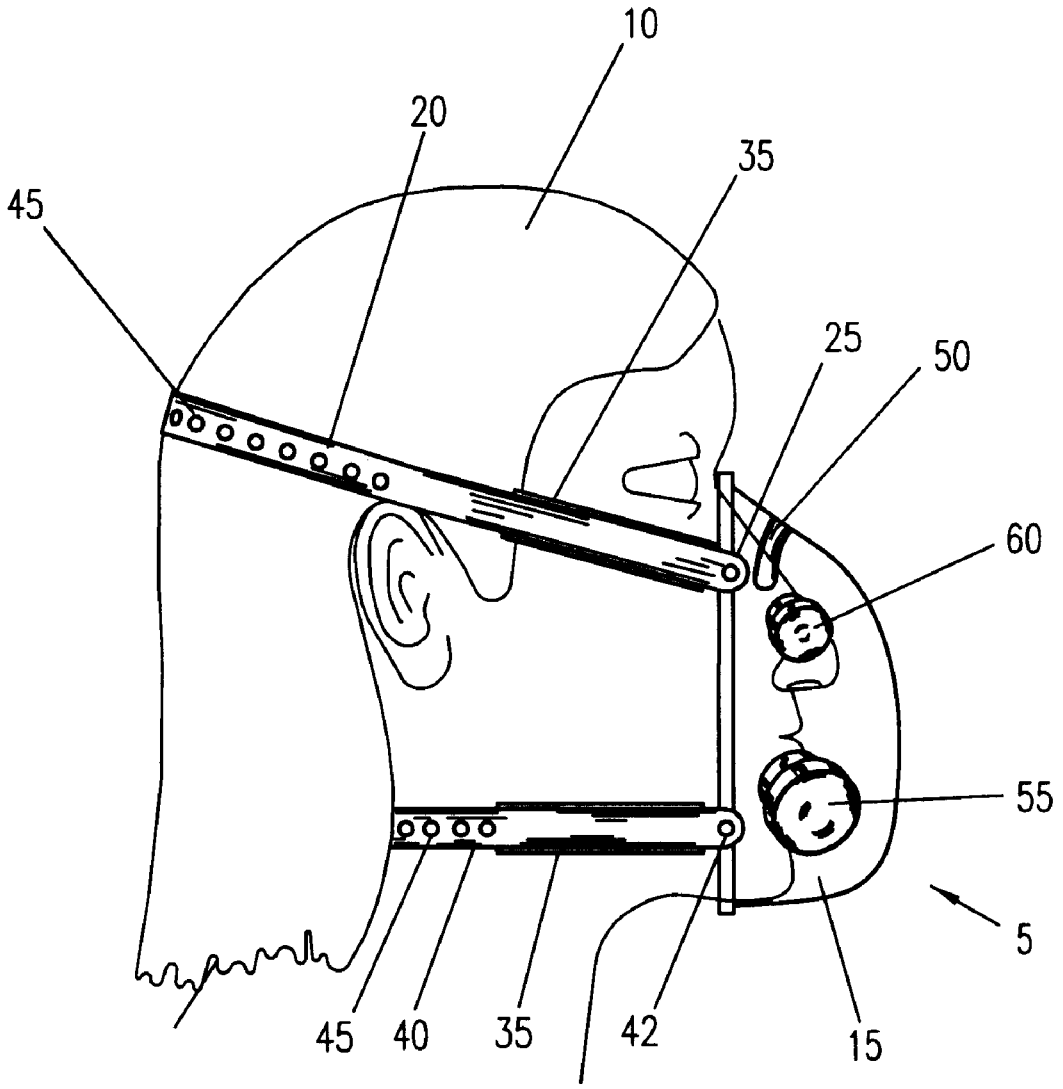
FIG. 1 is a perspective view of a multi-purpose oxygen face mask shown in a utilized state on a patient according to the preferred embodiment of the present invention.

Referring now to FIG. 1, a perspective view of a multi-purpose oxygen face mask 5 shown in a utilized state on a patient 10 according to the preferred embodiment of the present invention is disclosed. A mask body 15 manufactured from a suitable semi-flexible material such as PVC (polyvinyl chloride) compose the main body of the multi-purpose oxygen face mask 5. A head strap 20, connected to the mask body 15 at a right head strap attachment point 25, extends from the mask body 15 around the rear of the patient's 10 head and connects to the mask body 15 at a left head strap attachment point 30 (not shown in this view). It is envisioned that the right head strap attachment point 25 and the left head strap attachment point 30 (not shown in this view) would allow for rotation around the connection point as would be found with a hook and hole arrangement, to allow for user adjustment and subsequent comfort. Each side of the head strap 20 near the mask body 15 is equipped with a piece of soft foam rubber 35. The purpose of the soft foam rubber 35 is to aid in the prevention of pressure sores over the cheek bones and the sensitive area above, and as will be seen later, below the patient's ears. Next a lower neck strap 40 is connected at a right lower neck strap attachment point 42 and extends around the rear of the patient's neck. It is connected at the other side at a left lower neck strap attachment point 43 (not shown in this view) in a manner similar to the head strap 20 and is also equipped with a piece of soft foam rubber 35. The purpose of the lower neck strap 40 is to stabilize the mask body 15 around the patient's head to prevent accidental dislodging. Both the head strap 20 and the lower neck strap 40 are equipped with a multiple hole adjustment and securing system 45 which secures on the opposite side of the mask body 15 as will be seen in greater detail hereinbelow. The head strap 20 and the lower neck strap 40 are manufactured from a non-elastic strap material, thus the adjustment feature as made available by the multiple hole adjustment and securing system 45 is necessary. By limiting the amount of pressure placed by the mask body 15 against the patient's face, further-comfort is afforded to the patient. This is in lieu of the constant pressure regardless of placement as one would find with conventional, non-adjustable elastic straps. In addition to the two fastening systems afforded by the head strap 20 and the lower neck strap 40, a third fastening means is provided by an aluminum nose clip 50. Upon initial placement of the multi-purpose oxygen face mask 5 upon the patient's face, the aluminum nose clip 50 is gently pinched around the patient's nose to provide a closer fitting of the mask body 15 around the patient's nose and cheek area. The aluminum nose clip 50 with its aluminum construction is easily formed by the care giver, yet retains its shape after initial adjustment for an indefinite period of time. Located on the lower portion of the mask body 15 near the patient's nose and mouth area is a right lower port 55. Located directly above the right lower port 55 is a right upper port 60. Located on the opposite side of the mask body 15 in relation to a vertical axis with reference to the right lower port 55 and the right upper port 60 is a left lower port 65 (not shown in this FIG.) and a left upper port 70 (not shown in this FIG.) respectively. The purpose and function of the right lower port 55, the right upper port 60, the left lower port 65, and the left upper port 70 will be described in greater detail hereinbelow.

Figure 2:
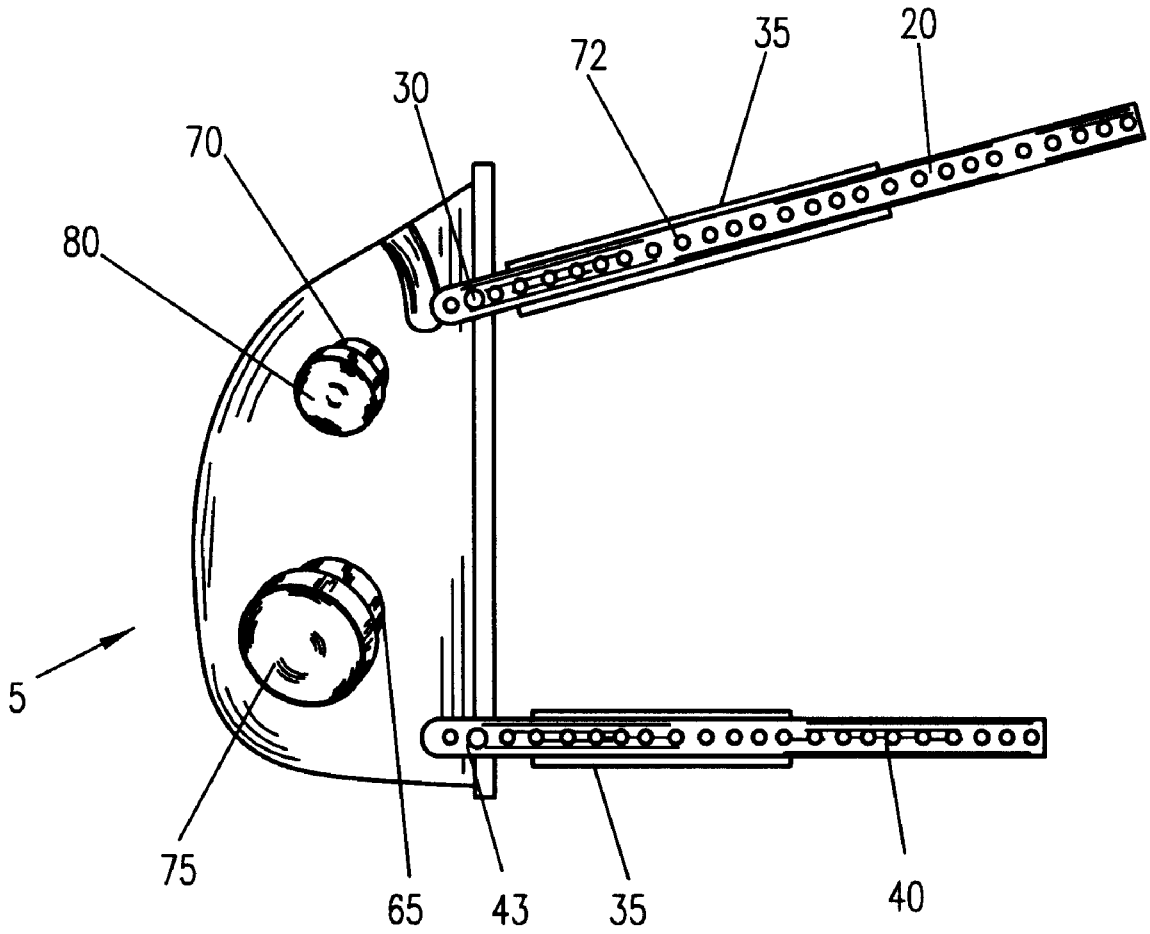
FIG. 2 is a left side elevation view of a multi-purpose oxygen face mask.

Referring next to FIG. 2, a left side elevational view of the multi-purpose oxygen face mask 5 is shown. The rotational design of the left head strap attachment point 30 and the left lower neck strap attachment point 43 allows for movement of the patient's head, while yet maintaining a tight seal around the patient's nose, cheek, and chin area. A plurality of adjustment holes 72 in the head strap 20 and the neck strap 40 are terminated at the left head strap attachment point 30 and the left lower neck strap attachment point 43 respectively after an adequately tight fit is established thus forming the multiple hole adjustment and securing system 45. Excess head strap 20 and excess neck strap 40 that remains after fastening the multi-purpose oxygen face mask 5 may either be left hanging or cut off after the initial fitting of the multi-purpose oxygen face mask 5. It is envisioned that the left head strap attachment point 30 and the left lower neck( strap attachment point 43 would be of a hook type nature though it can be seen by those familiar in the art that other types of fastening systems such as pins, rivets, and the like could also be utilized. The left lower port 65 and the left upper port 70 are equipped with a lower port cap 75 and an upper port cap 80 respectively.

Figure 3:
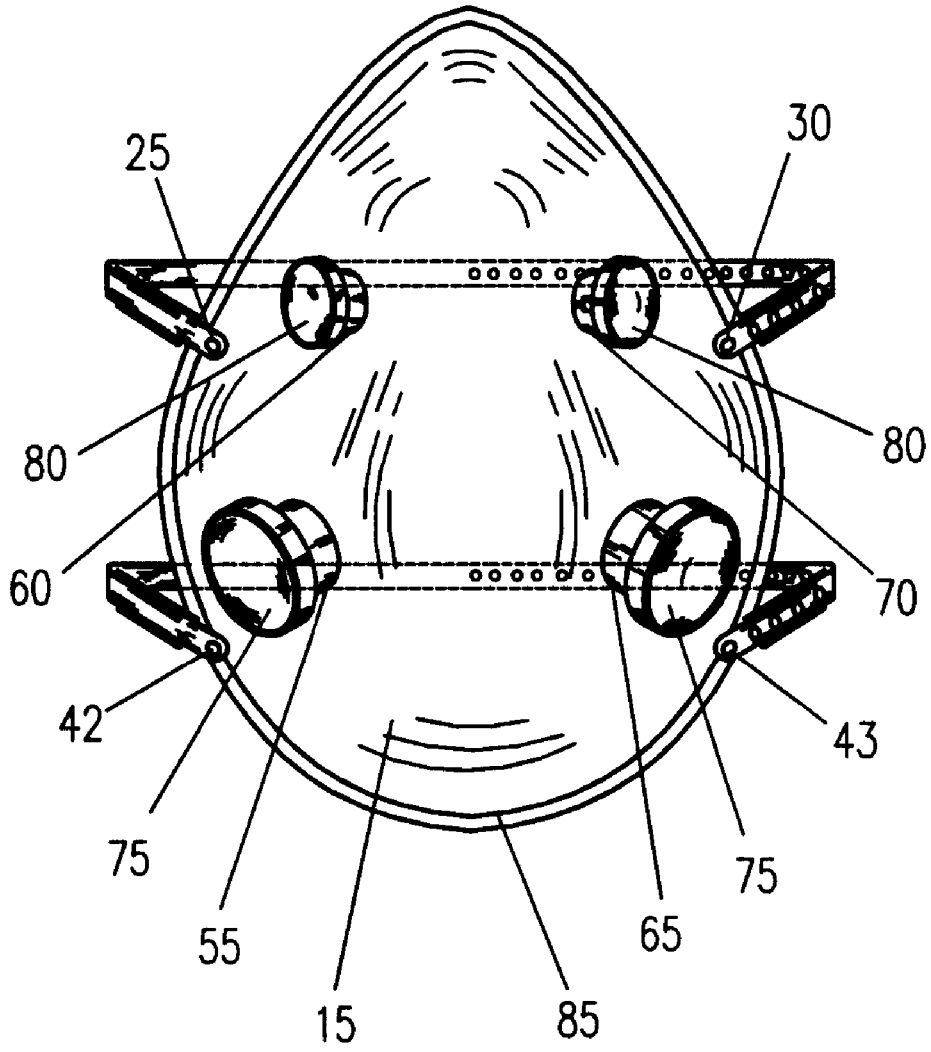
FIG. 3 is a front elevation view of a multi-purpose oxygen face mask.

Referring now to FIG. 3, a front view of the multi-purpose oxygen face mask 5 is depicted. The right lower port 55 and the right upper port 60 are equipped with a lower, port cap 75 and an upper port cap 80 as are the left lower port 65 and the left upper port 70 as previously mentioned. The lower port cap 75 and the upper port: cap 80 are of friction fit nature and are easily removed without the use of tools. The connection formed by the right lower port 55, the right upper port 60, the left lower port 65 and the left upper port 70 with the lower port cap 75 and the upper port cap 80 are of the same nature as one would find with connecting hoses and other medical appliances and would possess such details as alignment grooves, threaded connections and friction fit snap ridges. This feature allows quick interchanging with existing components found in a health care environment. Around the perimeter of the mask body 15 is a sealing ring 85 which provides an increased cross-sectional area to increase the air sealing properties of the multi-purpose oxygen face mask 5 to the patient's face.

Figure 4:
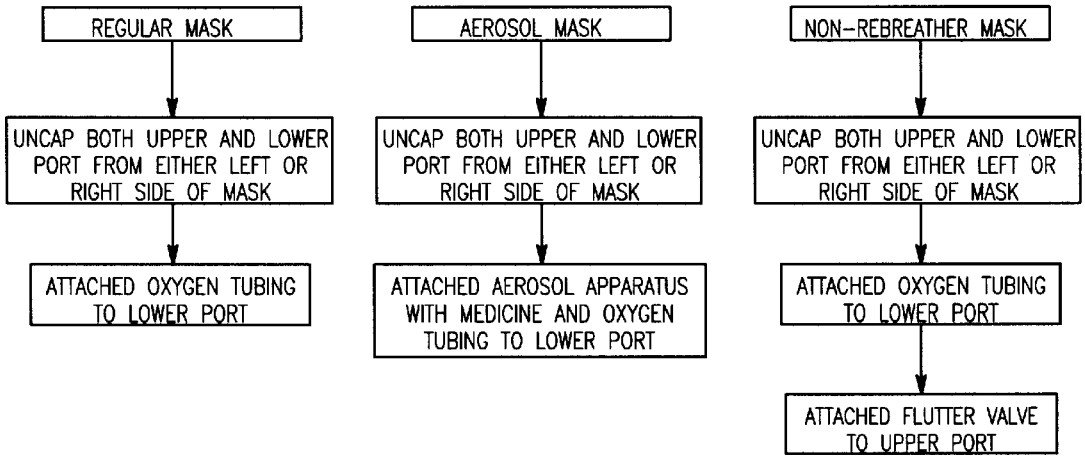
FIG. 4 is a descriptive flow chart depicting the setup sequences for the three operational modes of the multi-purpose oxygen face mask.

Referring finally to FIG. 4, a descriptive flow chart depicting the setup sequences for the three operational modes of the multi-purpose oxygen face mask 5 (not shown in this FIG.) is disclosed. The flow chart depicted details the steps necessary to prepare the multi-purpose oxygen face mask 5 (not shown in this FIG.) for use with a patient. It does not detail other necessary steps associated with a conventional mask. Such steps include but are not limited to fitting the mask to the patient's face, adjusting oxygen or medicine flow rates, verifying procedures and the like. To use the multi-purpose oxygen face mask 5 (not shown in this FIG.) as a regular oxygen mask, the care giver would remove the lower port cap 75 (not shown in this FIG.) and the upper port cap 80 (not shown in this FIG.) from either the left or right side of the multi-purpose oxygen face mask 5 (not shown in this FIG.) The side of the mask used depends on environmental conditions such as which side of the patient the existing oxygen connection is on as well as patient preference. Next the conventional oxygen tubing will be attached to the multi-purpose oxygen face mask 5 (not shown in this FIG.) making it ready for use. To use the multi-purpose oxygen face mask 5 (not shown in this FIG.) as an aerosol mask, the same procedures will be followed, but in lieu of attaching oxygen tubing, the care giver would connect the aerosol apparatus to the lower port, thus providing the necessary mixture of oxygen and medicine. To use the multi-purpose oxygen face mask 5 (not shown in this FIG.) as a non-rebreather mask, the same initial steps involved in setting the multi-purpose oxygen face mask 5 (not shown in this FIG.) as a regular mask would be followed, with the additional step of connecting a flutter valve to the upper port.

2. Operation of the Preferred Embodiment

In operation, the present invention can be easily utilized by the common health care provider in a simple and effortless manner that results in greater comfort and increased medical benefit for the patient. To use the present invention with its preferred embodiment can best be described in conjunction with the perspective view of FIG. 1, the elevational views of FIG. 2 and FIG. 3, and the descriptive flow chart of FIG. 4.

The health care provider (or in some instances, the user himself) would first begin by selecting the mode of operation for the multi-purpose oxygen face mask 5. Then following the descriptive flow chart of FIG. 4, the health care provider would configure the multi-purpose oxygen face mask 5 for use and activate the oxygen supply. Next the multi-purpose oxygen face mask 5 is secured to the patient's face by encircling the patient's head with the head strap 20 and connecting the loose end of the head strap 20 supplied with a plurality of adjustment holes 72 to the left head strap attachment point 30. Next the lower neck strap 40 is attached in the same said manner using the left lower neck strap attachment point 43. Finally the aluminum nose clip 50 is gently pinched around the patient's nose and upper cheek area. It should be ensured that the patient's cheek and ear area is adequately protected from the head strap 20 and the lower neck strap 40 via the soft foam rubber 35. Finally, the complete operation of the multi-purpose oxygen face mask 5, as well as the patients general state of well being should be verified in accordance with general patient care recommendations.

The foregoing description is included to illustrate the operation of the preferred embodiment and is not meant to limit the scope of the invention. The scope of the invention is to be limited only by the following claims.

What is claimed is:

1. A multi-purpose oxygen face mask comprising:

a mask body;

a head strap connected to said mask body at a right head strap attachment point extending from said mask body around the rear of a patient's head and connects with said mask body at a left head strap attachment point, and wherein said right head strap attachment point and said left head strap attachment point allow for rotation around the connection point of the mask body and said head strap;

a lower neck strap connected at a right lower neck strap attachment point and extending around the rear of a patient's neck with the opposite end of said lower neck strap, opposite said right lower neck strap attachment point, connecting to a left lower neck strap attachment point, located on said mask body, opposite said right lower neck strap attachment point;

a right lower port, said right lower port located on the lower right portion of said mask body near the patient's nose and mouth area;

a right lower port cap; said right lower port cap covering said right lower port via a friction fit;

a right upper port; said right upper port located directly above said right lower port;

a right upper port cap; said right upper port cap covering said right upper port via a friction fit;

a left lower port, said left lower port located on the lower, left portion of said mask body near the patient's nose and mouth area;

a left lower port cap, said left lower port cap covering said left lower port via a friction fit;

a left upper port; said left upper port located directly above said left lower port; and a left upper port cap, said left upper port cap, said left upper port cap covering said left upper port via a friction fit.

2. The multi-purpose oxygen face mask of claim 1, wherein said head strap includes a multiple hole adjustment and securing system which secures to the left head strap attachment point, corresponding to the side of said mask body opposite said right head strap attachment point.

3. The multi-purpose oxygen face mask of claim 1, wherein said lower neck strap includes a multiple hole adjustment and securing system which secures on the opposite side of said mask body.

4. The multi-purpose oxygen face mask of claim 2, wherein said head strap is manufactured from a non-elastic strap material.

5. The multi-purpose oxygen face mask of claim 3, wherein said lower neck strap is manufactured from a non-elastic strap material.

6. The multi-purpose oxygen face mask of claim 1, further comprising:

third fastening means provided by an aluminum nose clip, such that upon initial placement of the multi-purpose oxygen face mask upon a patient's face, said aluminum nose clip is gently pinched around the patient's nose to provide a closer fitting of said mask body around the patient's nose and cheek area.

7. The multi-purpose oxygen face mask of claim 2, wherein said mask body is manufactured from a suitable semi-flexible material.

8. The multi-purpose oxygen face mask of claim 7, wherein said semi-flexible material comprises polyvinyl chloride.

9. The multi-purpose oxygen face mask of claim 1, further comprising soft foam rubber affixed at each side of said head strap near said mask body, said soft foam rubber configured and positioned such that said soft foam rubber aids in the prevention of pressure sores over the cheek bones and the sensitive area above and below a patient's ears.

10. The multi-purpose oxygen face mask of claim 1, wherein said left lower port is located on the opposite side of said mask body in relation to a vertical axis with reference to said right lower port.

11. The multi-purpose oxygen face mask of claim 1, wherein said left upper port is located on the opposite side of said mask body in relation to a vertical axis with reference to said right upper port.

* * * * *